US006049312A

United States Patent [19]

Lord et al.

[11] Patent Number: 6,049,312

[45] Date of Patent: Apr. 11, 2000

[54] ANTENNA SYSTEM WITH PLURAL REFLECTORS

[75] Inventors: Peter Lord, Mountain View; Howard Luh, Sunnyvale; Sina Barkeshli, Saratoga; Louis B. Brydon, San Carlos; Jeff Zaine, Pleasanton, all of Calif.

[73] Assignee: Space Systems/Loral, Inc., Palo Alto, Calif.

[21] Appl. No.: 09/021,926

[22] Filed: Feb. 11, 1998

[51] Int. Cl.[7] ..... H01Q 19/14

[52] U.S. Cl. ..... 343/781 P; 343/754; 343/755; 343/761; 343/781 R

[58] Field of Search ..... 343/781 P, 754, 343/755, 757, 758, 765, 781 R, 761

[56] References Cited

U.S. PATENT DOCUMENTS

| | | | |
|---|---|---|---|
| 3,898,667 | 8/1975 | Raab | 343/756 |
| 4,586,051 | 4/1986 | Saitto et al. | 343/703 |
| 4,647,938 | 3/1987 | Roederer et al. | 343/756 |
| 5,581,265 | 12/1996 | Stirland et al. | 343/756 |
| 5,673,056 | 9/1997 | Ramanujam et al. | 343/781 P |
| 5,847,681 | 12/1998 | Faherty et al. | 343/781 P |

*Primary Examiner*—Hoanganh Le
*Assistant Examiner*—Hoang Nguyen
*Attorney, Agent, or Firm*—Perman & Green, LLP

[57] ABSTRACT

An antenna system having a front reflector and a rear reflector arranged in tandem, a front feed for illuminating the front reflector, and a rear feed for illuminating the rear reflector. Each of the reflectors has a generally dish-shaped configuration, and the feeds are located in positions offset from axes of the respective reflectors. The front reflector is reflective to a first radiation, while being substantially transparent to a second radiation except for a fraction of the power of the second radiation. The fractional part of the second radiation is reflected from the first reflector as an interfering beam, the interfering beam being scanned away from a coverage region of a beam of the first radiation by an offset between the feeds. The radiations may differ in polarization or in frequency. There may be a complete shading of the rear reflector by the front reflector from the radiation of the rear feed to produce uniform illumination of the rear reflector for greater accuracy in a formation of a beam from the rear reflector. Six degrees of freedom in positioning and orientation of the reflectors and their feeds provides maximum design flexibility for obtaining a compact antenna.

16 Claims, 3 Drawing Sheets

ANTENNA SYSTEM WITH PLURAL REFLECTORS

BACKGROUND OF THE INVENTION

This invention relates to an antenna generating plural beams of radiation and, more particularly, to an antenna having front and rear antenna dish-shaped reflectors illuminated respectively by separate offset front and rear feeds, wherein the front reflector is transparent to radiation to be reflected by the rear reflector, the antenna having a compactness of size afforded by maximizing design flexibility.

Communications satellites encircling the earth may carry various antennas for forming beams of radiation for up-link received signals and down-link transmitted signals. The beams may be directed to one or more regions on the earth's surface, depending on the mission of the satellite. It is desirable to minimize the weight of an antenna system so as to allow the satellite to carry a larger payload. It is also highly desirable to minimize the size of the antenna.

One form of satellite antenna system comprises two antennas mounted within a single structure and providing for two separate beams for carrying two separate signals to different locations on the earth's surface. A support of the antenna system holds two antenna reflectors in tandem, namely, a rear reflector substantially behind a front reflector. The support also holds a front feed for illuminating the front reflector to produce a front beam, and a rear feed for illuminating the rear reflector to produce a rear beam. In one form of construction of antenna system, the two feeds generate beams of cross-polarized linear polarizations, such as horizontal and vertical polarizations, and the front reflector is reflective to radiation at one of the two polarizations while being transmissive to the radiation to be reflected by the rear reflector.

A problem arises with the foregoing type of antenna system in that the front reflector is not totally transparent to the rear-feed radiation, and reflects the rear-feed radiation as an interfering beam. Degradation of antenna performance occurs in the event that the interfering beam falls within the region of coverage of the front beam and interferes with the front beam.

A further problem arises with the foregoing type of antenna system in that, due to the offset positions of the two feeds, there are rays from the rear feed which pass through the front reflector to illuminate the rear reflector while other rays from the rear feed bypass the front reflector to illuminate directly the rear reflector. The front reflector, while being classified as being transparent to the radiation of the rear feed, does introduce a variation in direction of propagation and intensity as compared to the rays which bypass the front reflector. Thus, there is a partial shading of the rear reflector by the front reflector from rays of the rear feed. The resulting lack of uniformity in the illumination of the rear reflector introduces a degradation in the radiation pattern of the beam produced by the rear reflector.

SUMMARY OF THE INVENTION

The aforementioned problems are overcome and other advantages are provided by an antenna system having a front reflector and a rear reflector arranged in tandem, a front feed for illuminating the front reflector, and a rear feed for illuminating the rear reflector. Each of the reflectors has a generally dish-shaped configuration, and the feeds are located in positions offset from axes of the respective reflectors.

In accordance with the invention, the front reflector is reflective to a first radiation while being transparent or transmissive to a second radiation. Such a distinction between the propagation characteristics of the front reflector may be obtained by fabricating the front reflector of a series of closely located but spaced apart, parallel electrically conductive linear elements, such as a grid of parallel wires or conductive strips disposed on a transparent substrate. Linear polarization of radiation to be reflected from the front reflector is parallel to the conductive elements, while radiation which is to propagate through the front reflector has a linear polarization perpendicular to the electrically conductive elements. The foregoing distinction between the propagation characteristics may be obtained also by constructing the front reflector as a frequency selective surface (FSS) having an array of periodic geometric figures of electrically conductive elements, and wherein the radiations have different frequencies such that radiation at a first frequency is reflected by the front reflector while radiation at a second frequency, different from the first frequency, propagates through the front reflector to the rear reflector.

In a construction of the antenna of the invention, it is useful to regard the front feed and the front reflector as constituting a front subsystem, and the rear feed and the rear reflector as constituting a rear subsystem. Radiation from the front feed is intended for illumination of the front reflector to produce the front beam, and radiation from the fear feed is intended for illumination of the rear reflector to produce the rear beam. As noted above, some of the radiation from the rear feed may be reflected by the front reflector to produce an additional beam, referred to as an interfering beam, which interferes with the front beam if allowed to fall within the coverage of the front beam. In accordance with a feature of the invention, the interfering beam, is scanned away from the front beam so as to avoid interference with the front beam. It is noted that provision of such scanning by simply increasing a spacing between the front subsystem and the rear subsystem would result in an undesirable increase in the size of the antenna.

However, the invention accomplishes the scanning while attaining a compact configuration to the antenna by employing two separate coordinate systems, respectively, for independently positioning components of the front and the rear subsystems. This allows for an independent construction of the two subsystems and a maximum geometric flexibility of design for scanning the interfering beam while minimizing the size of the antenna. With respect to a positioning of each of the components of the subsystems relative to a supporting frame of the antenna, there are three independent coordinates of displacement and three independent coordinates of rotation for each of the reflectors and each of the feeds. By independent orientation and positioning of the components of the two subsystems, there is obtained an arrangement of the two reflectors and the two feeds resulting in a minimum antennas size for independent generation of the front and the rear beams without interference between the two beams.

The configuration of the antenna system with the two reflectors positioned in a substantially tandem arrangement and with the two feeds offset from the reflectors provides for a compact configuration of the antenna system, such a compact configuration being desirable for saving space in a spacecraft. Typically, in the construction of an antenna, the position of a feed is offset from the central axis of its reflector to avoid interference with the propagation of the beam. However, in the situation of plural antenna subsystems addressed by the invention, such offsetting for each subsystem does not insure elimination of the interfering beam. The invention provides for a distancing of one feed from the other feed to direct the interfering beam away from the coverage region of the front beam. This can be accomplished even with a close positioning of front reflector relative to rear reflector for minimal overall antenna size.

In a further aspect of the invention, it is noted that, in the compact configuration, there is a shading of the rear reflector by the front reflector from the radiation of the rear feed. In order to have a uniform illumination of the rear reflector, the invention provides for a uniform shading of the rear reflector. This is accomplished by extending peripheral regions of the front reflector so as to shade all of the rear reflector by the front reflector from rays of the rear feed. This insures that all radiation directed from the rear feed to the rear reflector propagates through the front reflector for uniform illumination of the rear reflector.

Any change in radiation pattern in the beam of the front reflector is compensated by a slight alteration in the shape of the surface of the front reflector to accomplish a beam shaping, such beam-shaping techniques being known in the antenna art. The foregoing construction of the invention allows for independent positioning and orientation of the reflectors and the feeds, thereby to facilitate the orientation and shaping of the beams to meet requirements of a mission of the satellite, while attaining a smallest size for the antenna. The compact size is made possible by the maximizing flexibility of the design.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION

Figure 1:
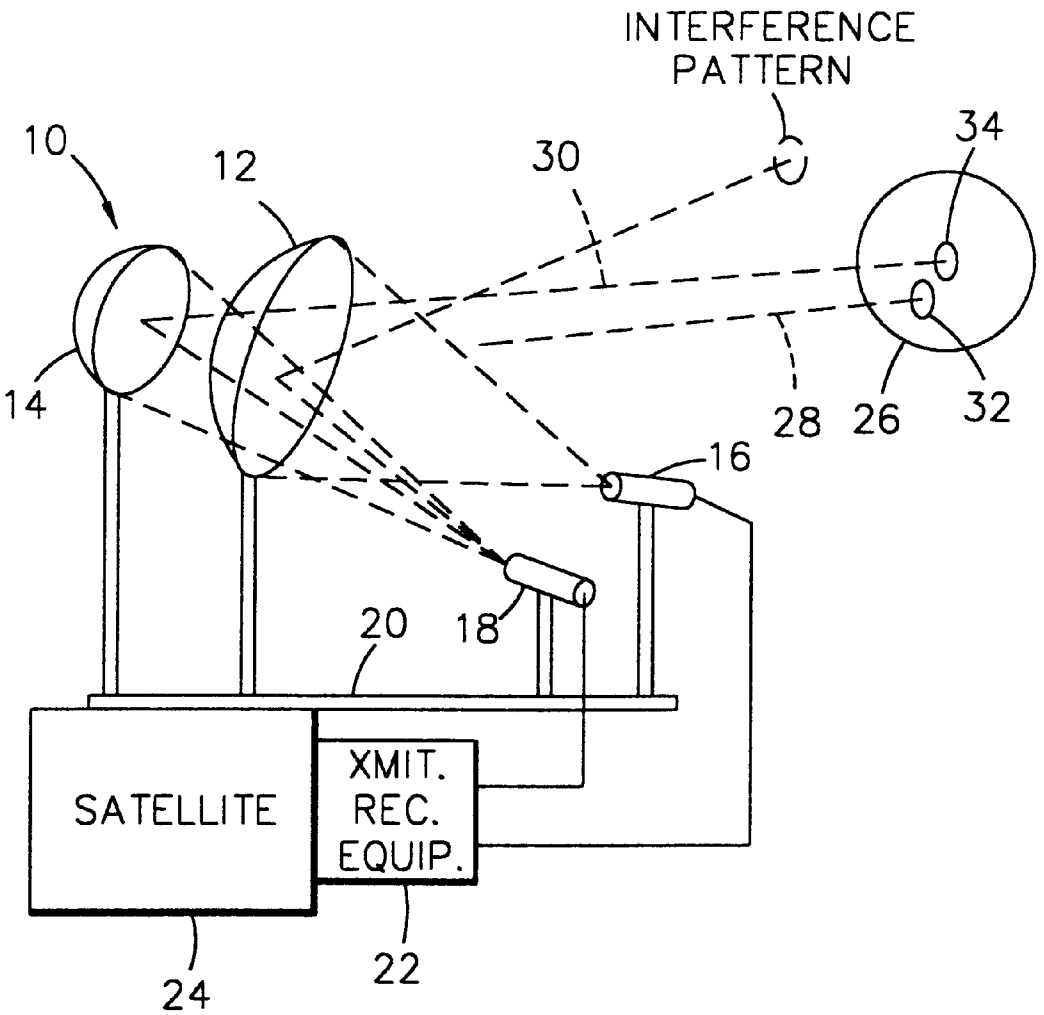
FIG. 1 shows a stylized view of an antenna system constructed in accordance with the invention.

With reference to FIG. 1, there is shown an antenna system 10 of the invention. The antenna system 10 comprises two reflectors 12 and 14 and two feeds 16 and 18 which are held and positioned by a support 20. The feeds 16 and 18 connect with transmit/receive equipment 22 which includes well-known circuitry (not shown) for transmission and reception of signals at various frequencies and polarizations. The antenna system 10 is particularly useful for satellite communications and, accordingly, is shown carried by a satellite 24 encircling the earth 26. Each of the reflectors 12 and 14 is configured as a concave dish, of which a concave surface faces the earth 26. Beams 28 and 30 of, respectively, the reflectors 12 and 14 propagate between the reflectors 12 and 14, respectively, and the earth 26 to provide beam footprints 32 and 34, respectively, on the surface of the earth 26.

Figure 4:
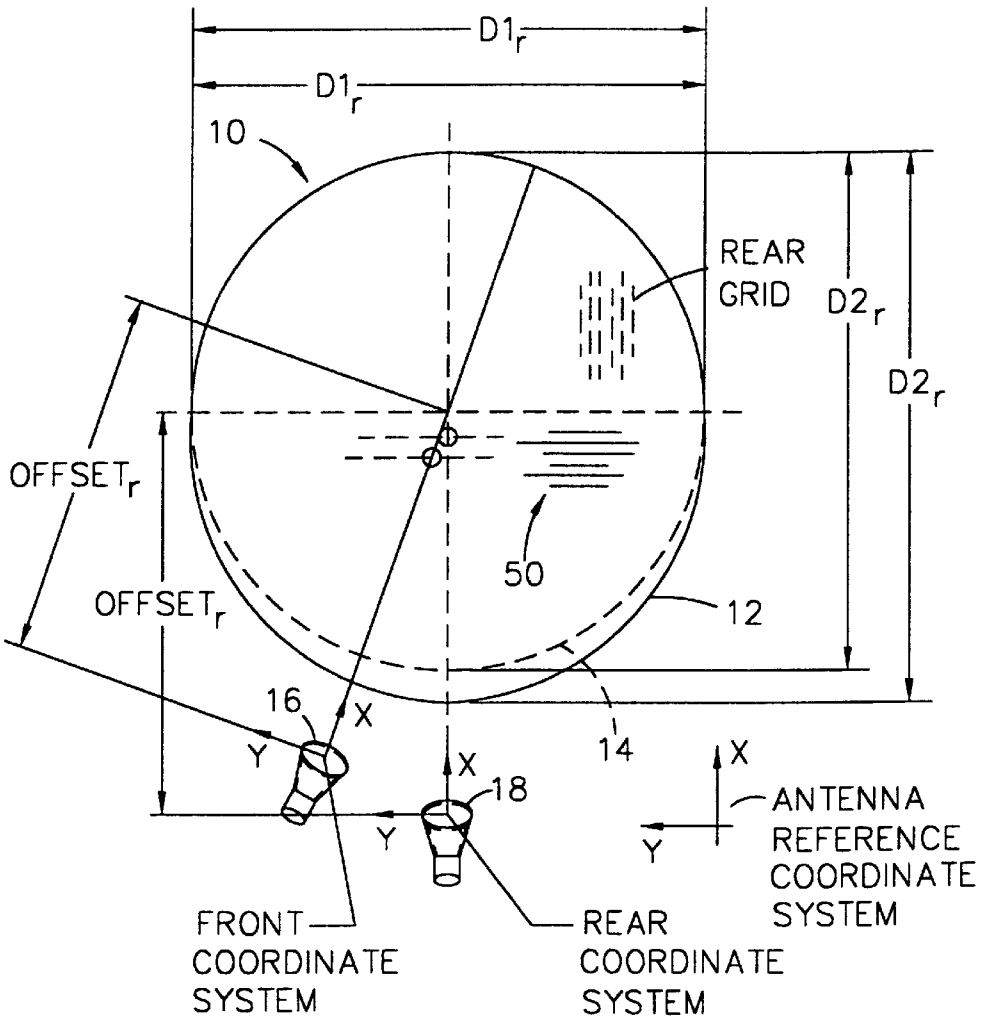
FIG. 4 is shows diagrammatically a transverse view of the antenna system of the invention showing an offsetting of one of the feeds relative to the other of the feeds, and showing further a polarization sensitive grid disposed in a front reflector of FIG. 1 in accordance with a first embodiment of the invention.

For ease of reference, each of the reflectors 12 and 14 is considered to be facing in the forward direction to direct its beam toward the earth and, with reference to the arrangement of FIG. 1, the reflector 12 is located in front of the reflector 14. Similarly, feed 16 may be referred to as the front feed for directing radiation toward the front reflector 12, and the feed 18 may be referred to as the rear feed for directing radiation toward the rear reflector 14. The respective beams 28 and 30 may be referred to similarly as the front beam and the rear beam. The beams 28 and 30 diverge, as shown in FIG. 1, to provide two separate and distinct footprints, namely, the foregoing footprints 32 and 34. The separation of the footprints 32 and 34 is attained, in part, by moving the feeds 16 and 18 towards opposite sides of the support 20, as shown in FIG. 4. It is to be understood that the portrayal of the two footprints 32 and 34 is presented by way of example, and that such footprints may be separate, partially overlapping, or completely overlapping, depending on the specific communication mission of the satellite.

It is noted that some part of the energy for the rear beam may be intercepted by the front reflector. Since the separation of the feed signals by the front reflector, in practice, cannot be perfect, some of the signal of the rear feed is reflected forward by the front reflector. This reflection of the rear-feed signal represents interference if allowed to fall within the coverage of the front beam. Such interference is eliminated, in accordance with a feature of the invention, by displacing the rear feed from the front feed. As a result, the interference pattern produced by the rear beam is scanned out of the region of coverage of the front beam. An increase in the spacing between the feeds may result in enlargement of the size of the antenna. It is desirable to accomplish the scanning of the interfering beam while maintaining the smallest possible antenna size. The invention attains the smallest possible antenna size for a given displacement between the feeds by achieving maximum geometric flexibility in describing the relative position of the rear feed from the front feed.

Figure 3:
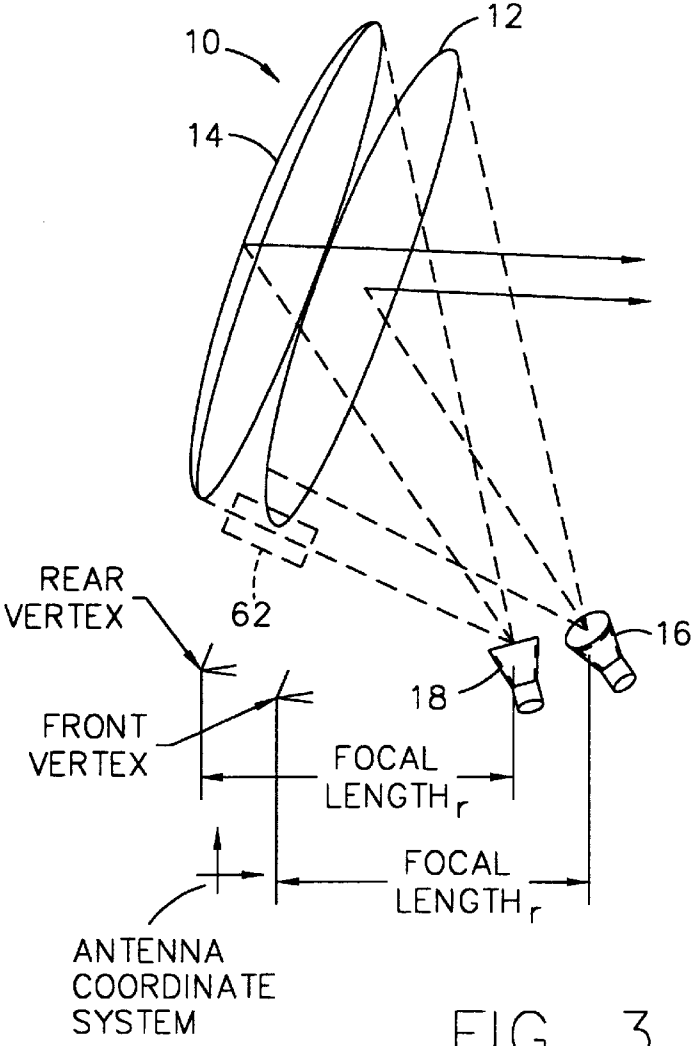
FIG. 3 shows diagrammatically a side view of an antenna system having a complete shading of a rear reflector in accordance with a feature of the invention, there being two feeds offset from axes of respective ones of the reflectors.

Maximum geometric flexibility in creating this displacement is achieved by creating the front subsystem, comprising feed 16 and reflector 12, and the rear subsystem, comprising feed 18 and reflector 14, as completely independent in reflector geometry, the reflector geometry concerning aperture size, focal length and offset. This is important for providing complete flexibility in locating one antenna subsystem with respect to the other, by six degrees of freedom, namely, three directions of translation and three directions of rotation. This flexibility is achieved by describing respective ones of the two antenna subsystems by means of separate coordinate systems which, in turn, have specific orientations and locations relative to a common coordinate system for the complete antenna. Each of the front and the rear subsystems are located by the six degrees of freedom from the antenna coordinate system (FIGS. 3 and 4). Combined with independent descriptions of the reflectors aperture size, this characterization of the antenna subsystems, each with its own reflector and feed, provides the designer with the maximum flexibility possible within the limitations of the geometry of the antenna.

The invention provides flexibility in the design of the antenna system 10 by permitting use of a shorter focal length for the front subsystem of the front reflector and its feed than for the rear subsystem of the rear reflector and its feed. This results in a more compact configuration of the system 10. The invention permits a person designing the antenna system to orient each of the reflectors within three degrees of freedom in choice of angle of orientation relative to the support 20, and to position each of the reflectors relative to the support 20 within three degrees of freedom, namely, forward/backward, right/left, and up/down.

With reference to FIGS. 1, 3 and 4, in a first embodiment of the invention, the front reflector 12 comprises a grid 50 of parallel, spaced-apart, electrically conductive elements oriented horizontally. The front feed 16 radiates linear horizontally polarized radiation which is reflected by the front reflector 12 towards the earth. The grid 50 is transparent to vertically polarized radiation and allows vertically polarized radiation to propagate through the front reflector 12. The rear feed 18 radiates linear vertically polarized radiation which propagates through the front reflector 12 to the rear reflector 14, and is reflected by the rear reflector 14 towards the earth. The reflectors 12 and 14 are operative each in reciprocal fashion to carry both up-link and down-link signals. To insure separation of the horizontally and the vertically polarized signals, the rear reflector 14 is provided with a grid (shown in phantom) having the same form as the grid 50 but with the electrically conductive elements oriented vertically.

In a preferred embodiment of the invention, the front reflector 12 comprises a honeycomb core (not shown) with front and back skins to provide a stiff dimensionally stable reflector. The core is constructed of RF (radio frequency) transparent material such as a composite of fibers (Dupont Kevlar fibers being suitable) disposed in a matrix of a polycyanate resin. The skins are constructed of RF (radio frequency) transparent film such as a polycarbonate (Dupont Kapton being suitable) disposed in a matrix of a polycyanate resin. The grid 50 is disposed on the front skin of the honeycomb structure, and may be formed by chemically etching a sheet of copper to provide the parallel electrically conductive strips. Similar construction may be employed for the rear reflector 14. The rear reflector comprises a suitable graphite fiber in a matrix.

Figure 2:
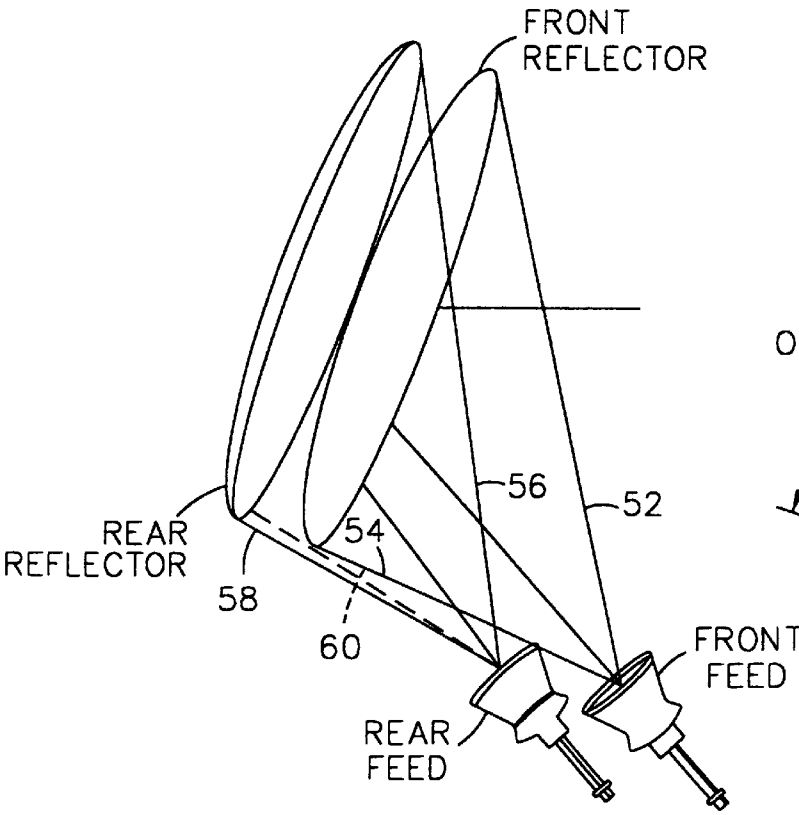
FIG. 2 shows diagrammatically a side view of an antenna system having a partial shading of a rear reflector and wherein the feeds are offset from each other.

FIG. 2 shows an embodiment of the antenna structure of the invention having front and rear reflectors illuminated respectively by front and rear feeds, wherein the front and the rear reflectors have the same size. Extreme rays of the radiation pattern of the front feed are shown at 52 and 54. Extreme rays of the radiation pattern of the rear feed are shown at 56 and 58. The extreme rays 52 and 54 impinge upon the periphery of the front reflector. The extreme ray 56 passes through the transparent front reflector to impinge upon the periphery of the rear reflector. The extreme ray 58 passes outside the transparent front reflector to impinge upon the periphery of the rear reflector. A further ray 60 from the rear feed to the rear reflector touches the edge of the front reflector. The two rays 58 and 60 designate a region of a direct illumination of the rear reflector while the rays 56 and 60 designate a region of indirect illumination of the rear reflector wherein the radiation passes through the front reflector. In this embodiment, a major portion of the rear reflector is illuminated indirectly while a smaller portion of the rear reflector is illuminated directly. While the front reflector is essentially transparent, it does introduce some attenuation and deflection of incident rays. The resulting uneven illumination of the rear reflector can be corrected by the preferred embodiment shown in FIGS. 1, 3 and 4.

The embodiment of the invention, as shown in FIGS. 1, 3 and 4, provides for uniform illumination of the rear reflector 14 by extending the cross-sectional dimensions of the front reflector 12 to eliminate the region of direct illumination disclosed in FIG. 2. This is demonstrated in FIG. 3 wherein the ray 58 (previously described in FIG. 2) passes through a peripheral region of the front reflector 12. Thus, all of the radiation which illuminates the rear reflector 14 passes through the front reflector 12 to attain the desired uniformity of illumination.

The extended region of the front reflector 12 is identified by an encircling dashed line 62 in FIG. 3, and is further identified in FIG. 4 by a showing of the diameters of the two reflectors 12 and 14. Therein, the smaller diameter of a slightly ellipsoidal shape of the reflectors 12 and 14 is represented by D1 and the larger diameter is represented by D2. The subscripts r and f identify the rear and the front reflector. FIG. 4 shows that both of the reflectors 12 and 14 have the same value of diameter D1, namely, that D1*r* equals D1*f*. However D2*f* has a greater value than D2*r* due to the extension of the cross-sectional dimensions of the front reflector 12 for obtaining the uniform illumination of the rear reflector 14. The resulting change in the shape and area of the front reflector 12 is relatively small as compared to the entire reflector 12. Therefore, any resulting shift in the configuration of the beam produced by the front reflector 12 can be compensated by a reshaping of the surface of the front reflector 12. Techniques for such reshaping of a reflector surface for adjustment of a beam configuration are well known, and are applied readily in the antenna system of the invention to compensate for the foregoing extension in the diameter of the front reflector 12.

Ideally, the front reflector 12 is considered to be a perfect reflector of radiation intended to be reflected by the reflector 12, and fully transmissive to radiation intended to propagate through the reflector 12 to the rear reflector 14. However, in practice, a small portion of the radiation intended to be reflected by the reflector 12 propagates through the reflector 12 to the reflector 14, and a small portion of the radiation to be transmitted through the reflector 12 to the reflector 14 is reflected by the reflector 12. The unwanted reflection may be manifested as an interfering beam which interferes with the front beam 28 of the front reflector 12, and the unwanted transmission may be manifested as a further interfering beam which interferes with the rear beam 30 of the rear reflector 14.

Figure 5:
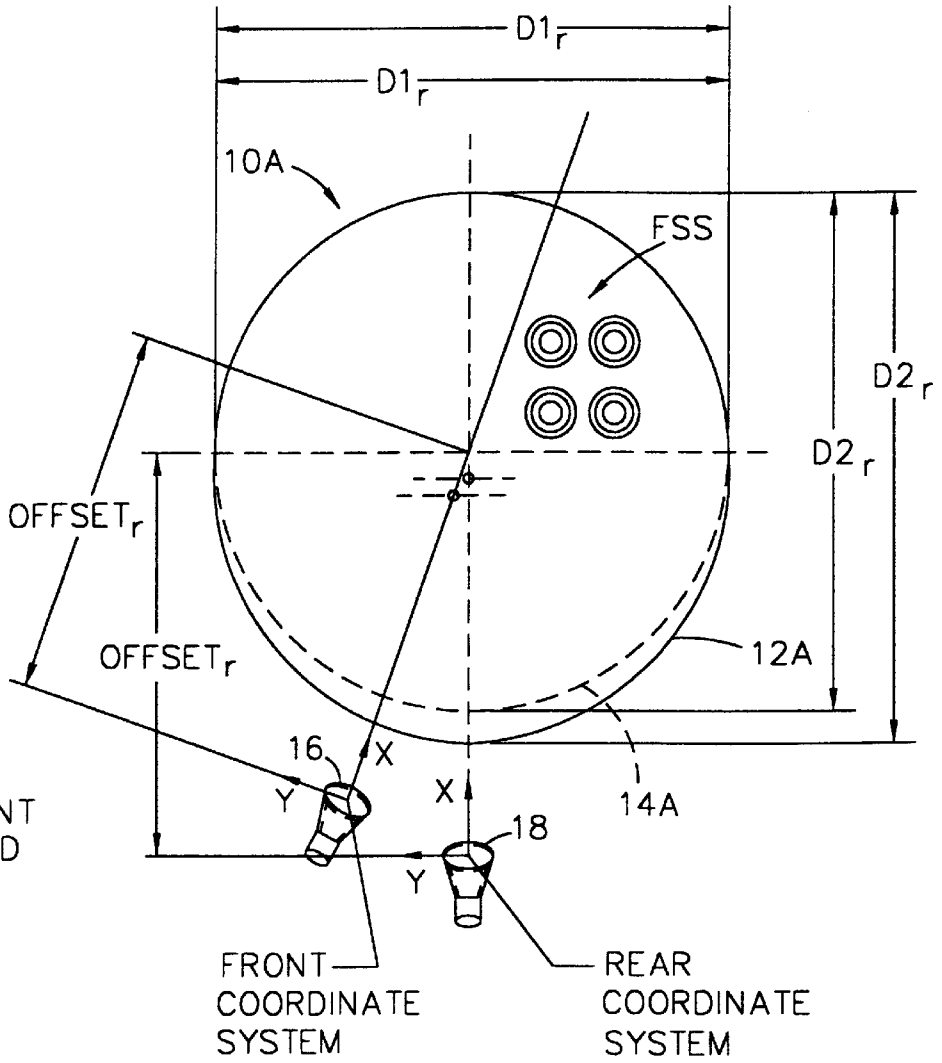
FIG. 5 is shows diagrammatically a transverse view of the antenna system of the invention showing an offsetting of one of the feeds relative to the other of the feeds, and showing further of an FSS disposed in a front reflector of FIG. 1 in accordance with a second embodiment of the invention.

The aforementioned degrees of freedom provided by the support 20 for the positioning and orientation of the components of the antenna system 10 enables one to construct the antenna system 10 by an orientation of the front subsystem relative to the rear subsystem such that, by way of example, the interfering beam produced by the unwanted reflection of the radiation of the rear feed 18 by the front reflector 12 is steered away from the region of coverage of the front beam 28. Thereby, this interfering beam no longer interferes with the front beam 28. The offset in orientation between the two subsystems is accompanied by an offset in the positions of the two feeds 16 and 18 from a common position with reference to the reference coordinate system of the antenna system 10, as shown in FIGS. 3 and 4. Each of the front and the rear subsystems is provided with its own coordinate system for locating its respective reflector and feed. As shown in FIGS. 3 and 4, the coordinate systems of the front and the rear subsystems are displaced from each other as well as from the reference coordinate system of the antenna system 10. These considerations in the positioning of the front and the rear subsystems apply also to the construction to be described with reference to FIG. 5.

In one aspect of the invention, described above, both of the feeds 16 and 18 are operative with radiation at the same carrier frequency. The difference in their respective radiations is in their polarizations, their radiations being cross polarized. However, in accordance with a second aspect of the invention, demonstrated with respect to an antenna system 10A shown in FIG. 5, the selective transparency of a front reflector 12A is attained by use of an FSS in place of the grid 50 of FIG. 4. Otherwise, the construction of the front reflector 12A is in accord with the principles of construction of the front reflector 12. The FSS may be formed by etching a layer of copper foil to provide concentric circles or other geometric shapes as are well know for an FSS. The FSS of the front reflector 12 may be used to reflect circularly polarized radiation, by way of example, at a first frequency while the rear reflector 14A is illuminated with circularly polarized radiation at a second frequency different from the first frequency. The radiation at the second frequency propagates through the FSS to illuminate the rear reflector 14A. The rear reflector 14A is provided with a continuous reflecting electrically conductive film, such as a copper film, instead of the grid employed with the rear reflector 14 of FIG. 4. The principles of the invention apply equally to both embodiments of the invention for attaining a uniform illumination of the rear reflector.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An antenna system for producing a plurality of beams including a first beam and a second beam, comprising:

a first element, a second element, a first feed and a second feed; and wherein said first element and said first feed are positioned for propagation of radiation between said first element and said first feed for formation of said first beam reflected by said first element;

said second element and said second feed are positioned on opposite sides of said first element for propagation of radiation between said second element and said second feed for formation of said second beam reflected by said second element, said positioning of said second element and said second feed on opposite sides of said first element resulting in a set of interfering beams comprising at least one interfering beam;

said first element is substantially transparent to radiation of said second feed for illuminating said second element with the radiation of said second feed while reflecting a portion of the power of the radiation of said second feed as said one interfering beam;

said first element and said first feed constitute a first subsystem providing said first beam of said antenna system, said second element and said second feed constitute a second subsystem providing said second beam of said antenna system; and said antenna system includes means for positioning each of said subsystems with three degrees of freedom of translation and three degrees of freedom of rotation to enable placement of said subsystems relative to each other to minimize the size of the antenna system while enabling a scanning of said interfering beams away from areas of coverage of the beams of said subsystems; and said second feed is angled from said first feed to direct said one interfering beam away from an area of coverage of said first beam.

2. An antenna system according to claim 1 wherein a magnitude of coverage of said first beam is equal to a magnitude of coverage of said second beam.

3. An antenna system according to claim 1 wherein a magnitude of coverage of said first beam differs from a magnitude of coverage of said second beam.

4. An antenna system according to claim 1 wherein said first element is a first reflector and said second element is a second reflector, said first reflector being equal in size to said second reflector.

5. An antenna system according to claim 1 wherein said first element is a first reflector and said second element is a second reflector, said first reflector differing in size from said second reflector.

6. An antenna system according to claim 1 wherein said first element is a first reflector and said second element is a second reflector, at least one of said reflectors having a parabolic reflecting surface.

7. An antenna system according to claim 1 wherein said first element is a first reflector and said second element is a second reflector, at least one of said reflectors having a reflecting surface which is shaped to provide a desired coverage beam.

8. An antenna system comprising:

a first element, a second element, a first feed and a second feed; and wherein said first element and said first feed are positioned for propagation of radiation between said first element and said first feed for formation of a first beam directed in a forward direction of said first element;

said second element and said second feed are positioned on opposite sides of said first element for propagation of radiation between said second element and said second feed for formation of a second beam directed in a forward direction of said second element;

said first element is operative to reflect radiation of said first feed having a first characteristic and to transmit radiation of said second feed having a second characteristic different from said first characteristic, each of said first and said second characteristics being a polarization or a frequency;

said second element reflects radiation of said second feed;

said first element is substantially transparent to radiation of said second feed for illuminating said second element with the radiation of said second feed while reflecting a portion of the power of the radiation of said second feed as an interfering beam in a forward direction of said first element;

said antenna system includes means for positioning each of said subsystems with three degrees of freedom of translation and three degrees of freedom of rotation to enable placement of said subsystems relative to each other to minimize the size of the antenna system while enabling a scanning of said interfering beams away from areas of coverage of the beams of said subsystems; and said second feed is angled from said first feed to direct said interfering beam away from an area of coverage of said first beam.

9. An antenna system according to claim 8 wherein:

said first element and said first feed constitute a first subsystem of said antenna system, said second element and said second feed constitute a second subsystem of said antenna system; and said antenna system includes means for positioning each of said subsystems with three degrees of freedom of translation and three degrees of freedom of rotation to enable placement of said subsystems relative to each other to minimize the size of the antenna system.

10. An antenna system according to claim 9 wherein said positioning means allows for independent positioning and orientation of said first subsystem relative to said second subsystem for scanning said interfering beam away from the area of coverage of said first beam while minimizing the size of the antenna system.

11. An antenna system according to claim 10 wherein said positioning means comprises a support which allows independent positioning and orientation of said first feed relative to said second feed.

12. An antenna system according to claim 8 wherein:

said first element casts a shadow upon said second element with respect to illumination of said second element by said second feed, said shadow constituting a reduction in the intensity of said radiation of said second feed; and said first element extends in a direction transverse to rays of radiation of said second feed to enclose completely said second element within said shadow, thereby to attain a uniform illumination of said second element with radiation of said second feed.

13. An antenna system according to claim 8 wherein said first element comprises a grid of spaced-apart, parallel, linear, electrically conductive elements.

14. An antenna system according to claim 8 wherein said first element comprises a frequency selective surface.

15. An antenna system according to claim 8 wherein said first element comprises a grid of spaced-apart, parallel, linear, electrically conductive elements; and said first characteristic is vertical polarization and said second characteristic is horizontal polarization.

16. An antenna system according to claim 8 wherein said first element comprises a frequency selective surface; and said first characteristic is a first frequency and said second characteristic is a second frequency.

* * * * *